United States Patent [19]

Mahan

[11] Patent Number: 4,889,305

[45] Date of Patent: Dec. 26, 1989

[54] UNIVERSAL BRACKET

[76] Inventor: Larry G. Mahan, 14 Greenwood, Lebanon, Mo. 65536

[21] Appl. No.: 208,160

[22] Filed: Jun. 17, 1988

[51] Int. Cl.[4] ..... A47H 1/10

[52] U.S. Cl. ..... 248/265; 248/253; 248/255; 248/268

[58] Field of Search ..... 248/268, 265, 267, 266, 248/264, 262, 263, 261, 255, 253, 208, 300, 254, 251; 160/123

[56] References Cited

U.S. PATENT DOCUMENTS

| | | | |
|---|---|---|---|
| 507,440 | 10/1893 | Knapp | 248/266 |
| 758,216 | 4/1904 | Reiss et al. . | |
| 762,594 | 6/1904 | Michaels . | |
| 978,247 | 12/1910 | Weiher | 248/254 |
| 1,012,369 | 12/1911 | Kolb . | |
| 1,053,796 | 2/1913 | Emery . | |
| 1,138,750 | 5/1915 | Greenwood | 248/266 |
| 1,139,729 | 5/1915 | Rounds | 248/267 |
| 1,183,519 | 5/1916 | Barrett . | |
| 1,370,817 | 7/1921 | Jackson . | |
| 1,391,528 | 9/1921 | Cranford . | |
| 1,455,166 | 5/1923 | Hinderliter | 248/266 |
| 1,501,843 | 7/1924 | Durnell et al. | 248/252 |
| 2,506,160 | 5/1950 | Martin et al. | 248/255 |
| 2,545,147 | 3/1951 | Jensen | 248/259 |
| 2,679,373 | 5/1974 | Henley | 248/267 X |
| 2,783,014 | 2/1974 | Kenney | 248/263 |
| 3,856,249 | 12/1974 | Frye | 248/205.3 |
| 4,684,095 | 8/1987 | Athey | 248/263 X |
| 4,762,162 | 8/1988 | Chochrek | 248/268 X |

*Primary Examiner*—Ramon O. Ramirez

[57] ABSTRACT

A bracket supportable on a trim member of a window or door. The bracket can be installed with only a few, if any, tools. The bracket provides for installation of opposing brackets with little, if any, measurement required. The bracket when assembled, includes a substantially rigid sub-structure that is at least partially supportable by an adjacent wall portion. This sub-structure is cantilevered off the end of the trim member and does not cover the face of the trim member. A support flange can be added to spread the wall support of the bracket over a larger wall surface area.

2 Claims, 2 Drawing Sheets

FIG. 1.
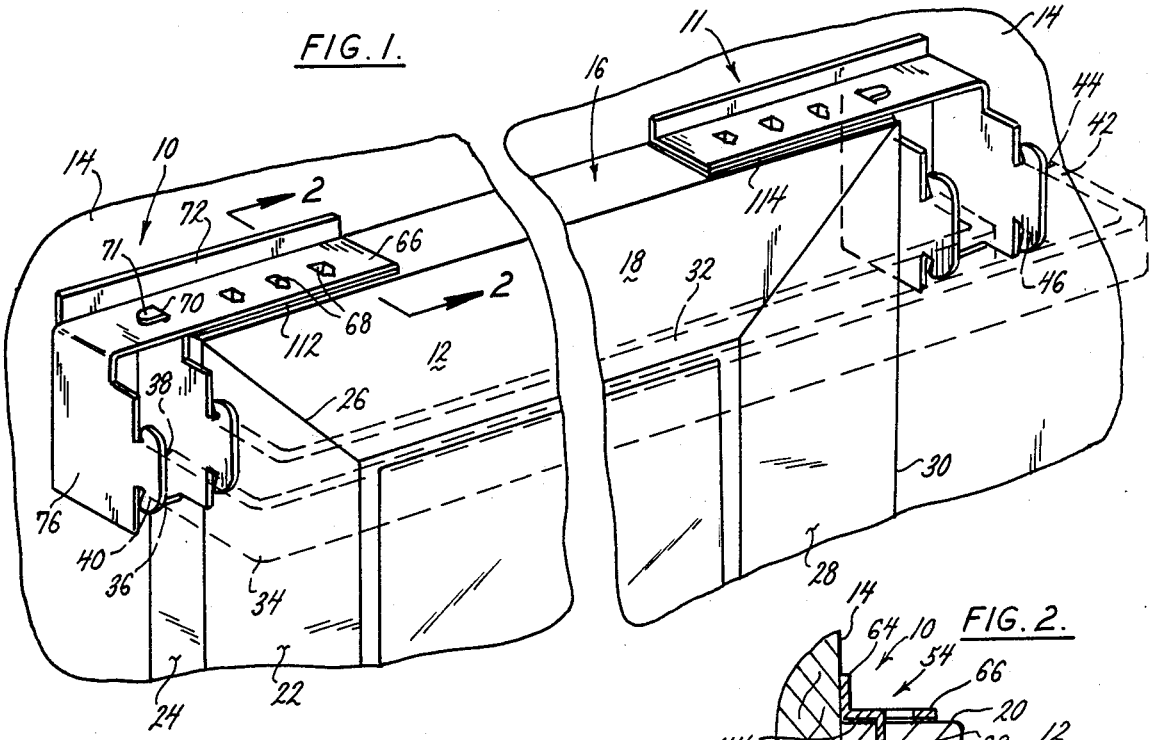
FIG. 2.
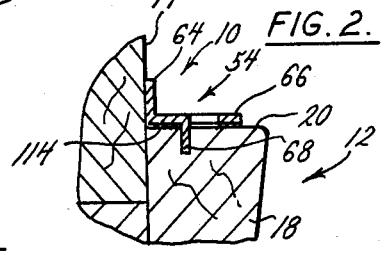
FIG. 3.
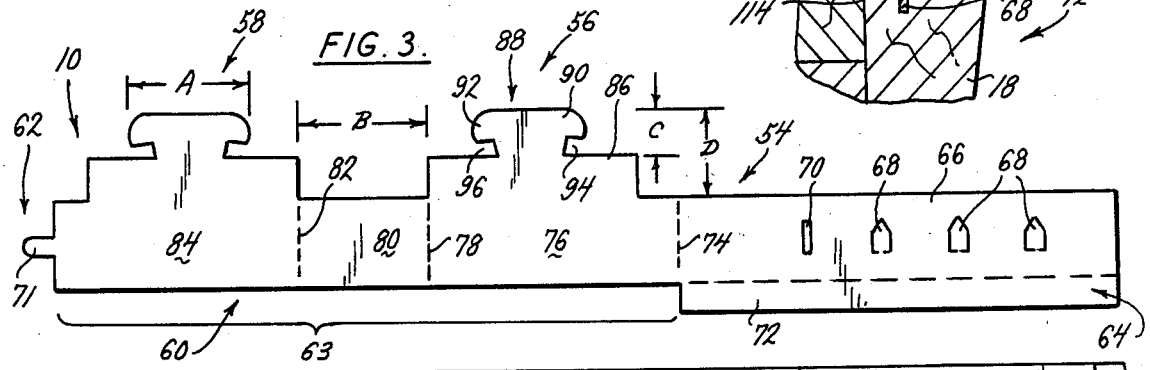
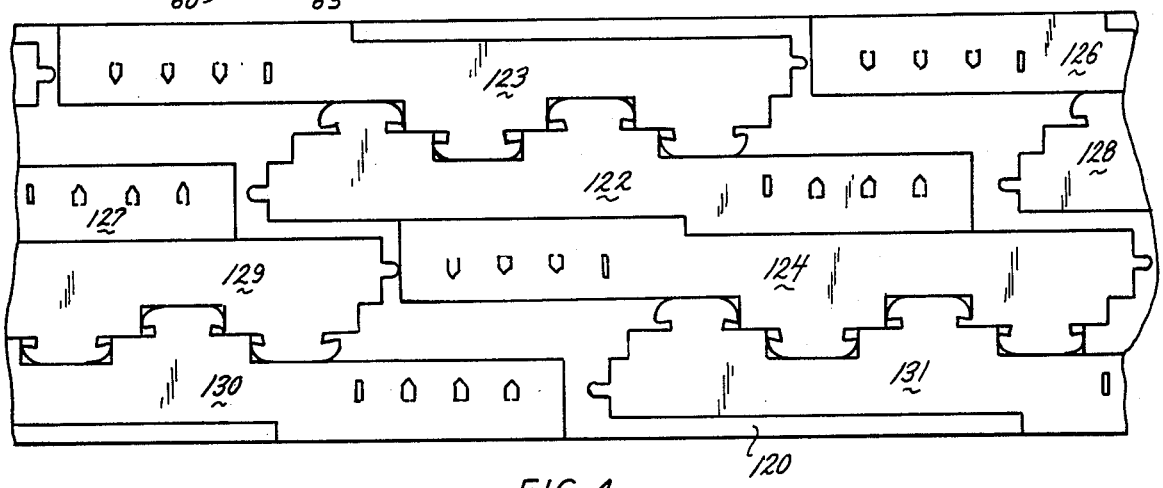
FIG. 4.

UNIVERSAL BRACKET

BACKGROUND OF THE INVENTION

This invention relates to brackets used to support curtain rods, window shades, draperies and other window treatments. More particularly, the invention relates to a universal, low cost, bracket for the purpose recited, which can be easily installed and removed typically with few tools and with only minimum measurement.

With a conventional drapery curtain or window shade installation it is generally necessary to employ one or more of any number of various supporting fixtures or brackets presently available. It is known that window shades typically require one type of supporting fixture, curtain rods another and draperies still another. There are any number of rods and hangers for supporting window treatments, such as crane rods, festoon holders and various types of draw curtains, cornice mountings and valence boards. Corresponding brackets, fixtures and supports are generally attached to a wooden frame member of a window, alcove, entryway, door way or the like. It is often difficult to install these support brackets in a proper position and in a proper spatial relationship with an opposing support bracket (since pairs of properly spaced and properly aligned support brackets are typically required to properly install the desired window treatment). Subsequent removal of a support bracket leaves exposed screw, nail or tack holes in the face of the woodwork or wooden frame member. Support fixtures or brackets normally cannot be mounted beyond the edges of the woodwork or wooden frame member in an adjacent wall portion since the support fixtures or brackets are not readily secured to a wall without damaging the wall. The support fixtures or brackets that are mountable at the edges of the woodwork generally deface or cover the face of the woodwork. There are presently known a number of complicated schemes for overcoming some of the identified disadvantages.

These schemes can use pairs of fixtures connected with a spring-biased intermediate member as in U.S. Pat. No. 1,501,843 or supports sandwiched between members of a window casing framework as in U.S. Pat. No. 970,247.

Accordingly, it is an object of the present invention to provide a bracket that can be easily installed without nails, tacks, screws or other fasteners. The bracket provides for insertion of blade members into a frame member.

Another object of the present invention is to provide a bracket that can be inexpensively manufactured from a desired material. The universal feature of the bracket requires that generally only one bracket design is required (except, for example, for window shades wherein the opposing pintles of the window shade do not have the same shape).

A further object of the present invention provides a bracket that can be uniformly manufactured relatively inexpensively using known die-stamping techniques. The finished brackets are produced efficiently and with a minimum of waste, due to a generally interfitting configuration.

Still another object of the present invention is to provide a bracket that can be mounted or removed with few if any tools and little if any measurement. The bracket positions the rod, shade, bar or the like, with respect to the window, door, alcove, bay framing or the like.

Another object of the present invention is to provide a bracket that substantially supports a window shade, curtain rod, drapery rod or the like without the need to nail, tack, screw or otherwise fasten the bracket to the frame, wood work, trim or the like. In the present invention a blade or blades initially secure the bracket to an upper, unexposed surface of the trim and a rigid structure formed by connected bracket portions rests against an adjacent wall portion and is supported at least partially by the wall portion in reaction to the weight of the rod, drape, panel, shade or the like supported by the bracket. In another embodiment the blades can be replaced with an adhesive to initially secure the bracket in place.

SUMMARY OF THE INVENTION

To accomplish these and other objects, the bracket of this invention includes bracket support means for providing supports for the bracket on a portion of a frame or trim member of a window, doorway, entry-way, alcove or the like. The bracket further includes an accessory support means that is intended to support an accessory, for example, a rod or hanger for supporting any one of a number of window treatments such as curtains or drapes or other accessories such as various types of draw curtains, cornice mountings and valence boards, crane rods, festoon holders as well as roller shades. The accessory support means defines a framing means providing a substantially rigid sub-structure. This sub-structure is at least partially supportable by a wall portion adjacent the trim member. Support of the sub-structure by the adjacent wall portion is in reaction to the weight of the accessory supported by he bracket. Reaction to the weight of the accessory results in improved support of the bracket and the accessory.

These and other objects and features of the present invention will be better understood and appreciated from the following detailed description, selected for purposes of illustration and shown in the accompanying drawings.

BRIEF DESCRIPTION OF THE DRAWINGS

FIG. 1 is a perspective view of a pair of brackets in accordance with this invention shown supported by a window frame trim;

FIG. 2 is a sectional view taken along line 2—2 in FIG. 1;

FIG. 3 is a plan view of a bracket in accordance with this invention;

FIG. 4 is a plan view of a sheet of material illustrating a die-stamping pattern for stamping brackets in accordance with this invention;

DETAILED DESCRIPTION

Figure 6:
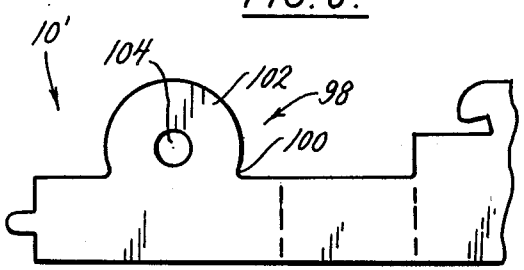
FIG. 6 is a partial plan view of one end of a bracket for use with the bracket in FIG. 5.

Referring now to the drawings there is shown a preferred embodiment for the bracket and one modified embodiment in accordance with this invention. It will be understood that other modifications are possible to suit the fixture to be supported. The preferred embodiment and its modification are described in connection with a curtain rod and a roller-type shade. The bracket of the present invention is particularly adapted for providing easy installation and removal on a window or door trim with little if any need for tools or measurements for installation or the alignment of a pair of the brackets.

The drawings show one single piece bracket 10 on the left and another single piece bracket 11 on the right of a cased frame window 12. Adjacent wall portion 14 is shown in FIGS. 1 and 2. The cased frame window shown in FIG. 1 for the purpose of illustration includes upper and lower sash (not shown), and an upper frame member or trim portion 16. The trim portion 16 includes a face surface 18 and a top surface 20. It will be understood that use of the bracket is not limited to casement windows.

As shown in FIG. 1 the cased frame window 12 has a side frame member 22 with a side surface 24. The upper frame member or trim member portion 16 and a side frame member 22 are typically joined at a mitered joint 26. As further shown in FIG. 1 the cased frame window 12 has an opposing side frame member 28 with an opposing side surface 30. The upper frame member or trim member portion 16 and the opposing side frame member 28 are typically joined at an opposing mitered joint 32. It will be understood that the component frame members of a cased frame window can be formed with any number or types of joints and construction is not limited to mitered joints. It will be further understood that the cased frame window 12 has been selected for purposes of illustration only and that the bracket of the present invention is suitable for use on other trimmed openings such as doorways, entry-ways, alcoves or the like, that is, when a molding is used.

The brackets 10 and 11 are shown as intended for supporting a typical style of accessory such as a standard curtain rod. A curtain rod 34 typically has one end portion 36 with an upper support receiving slot 38 and a lower support receiving slot 40. An opposing end portion 42 of the curtain rod 34 has an opposing upper support receiving slot 44 and an opposing lower support receiving slot 46.

Figure 5:
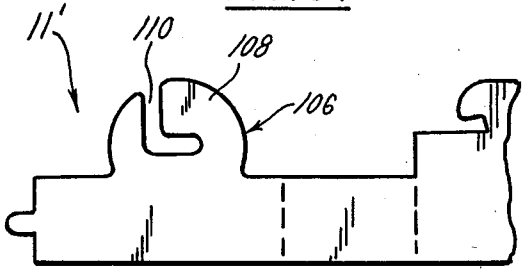
FIG. 5 is a partial plan view of one end of a bracket used to support a typical roller shade.

While it is not practical to illustrate all of the many accessories with which the present invention can be used, one other common style of accessory, a roller-type window shade. The roller shade is one accessory that requires a modification to opposing brackets 10' and 11' as shown in FIGS. 5 and 6. One bracket receives a circular cross-section shaft or pintle and the opposing bracket receives a generally rectangular cross-section shaft or pintle. As indicated in FIGS. 5 and 6, a bracket can support different accessories, e.g. a window shade (roller-type) and a drapery rod (e.g. 34).

Referring now to FIGS. 2 and 3 and a typical bracket 10 it will be seen that the typical bracket 10 generally includes a bracket support means 54, one or more accessory support means 56, 58, a joining member 60 and connecting means 62. A framing means 63 is defined by the foregoing as will be further described herein. The bracket 10 in one embodiment can include a flange means 64 for further stabilizing the bracket 10. Flange means 64 is at least partially supportable by the adjacent wall portion 14. In a preferred embodiment flange means 64 is an extension of bracket support means 54. It will be understood that the dashed lines represent bend lines for forming the bracket from the flat bracket 10 illustrated in FIG. 3.

The bracket support means 54 supports the bracket 10 on the trim portion 16 or the trim member as shown in FIGS. 1 and 2. The accessory support means 56 includes a supporting configuration styled to supportingly receive the desired accessory. In most embodiments, except for example as noted above, each accessory requires only one style of supporting configuration. The framing means 63 provides a substantially rigid substructure of the bracket 10. As will be further described herein, framing means 63 is at least partially supportable by the adjacent wall portion 14 adjacent the trim member portion 16. The weight of the accessory supported by the bracket improves the hold of the bracket support means 54 in the trim member portion 16. Furthermore, a significant portion of the accessory weight is also transferred through framing means 63 to the wall portion 14. When properly installed the bracket 10 provides cantilever support of the accessory weight without twist since framing means 63 rests against the wall portion 14.

Referring again to FIG. 3, specific portions of the bracket 10 now will be identified. FIG. 3 shows the bracket 10 as it would be stamped, die-cut or otherwise separated from a sheet of material, for example aluminum sheet stock.

Now referring more specifically and in more detail to the bracket 10 it will be seen that the bracket 10 includes a bracket support portion 66. A plurality of blades 68 are defined by the bracket support portion 66. It will be understood that one or more blades can be used and that the illustrated embodiment has three blades for penetration of the top surface 20 of the trim portion 16 as will be further described herein. The bracket support portion 66 defines a receiving means such as a slot 70 in a preferred embodiment. Further, the preferred embodiment includes a flange 72 to enhance or improve bracket support.

The bracket 10 includes a first bend portion 74 intermediate the bracket support portion 66 and a first support portion 76. A second bend portion 78 is intermediate the first support portion 76 and a connecting portion 80. A third bend portion 82 is intermediate the connecting portion 80 and a second support portion 84. Extending longitudinally outwardly from the second support 84 is a bendable tab portion 71 receivable by the slot 70, so as to form a framing means with a generally rectangular, substantially rigid sub-structure. It will be understood that, depending upon the bracket configuration desired, e.g., the number of accessories to be supported, that the sub-structure is not limited to a rectangular shape.

A support portion for a typical curtain rod and a typical roller shade are shown in FIGS. 1 and 5, 6. When the brackets 10 and 11 support a curtain rod a support portion extension 86 has a complementary supporting configuration 88. The two supporting configurations shown in FIG. 3 are the same. As shown in FIG. 3 there is provided an upper tang 90 and a lower tang 92. An upper bight 94 for receiving the curtain rod 34 is formed by the upper tang 90 and the support portion extension 86. A lower bight 96 also for receiving the curtain rod 34 is formed by the lower tang 92 and the support portion extension 86. The upper tang 90 fits into upper support receiving slot 38 or 44. The lower tang 92 fits into lower support receiving slot 40 or 46.

In some instances, for example when supporting a roller shade, the brackets 10 and 11 have different supporting configurations. As shown in FIGS. 5 and 6 the bracket 10' has a supporting configuration 98 including a neck portion 100 and a disk portion 102. The disk portion 102 defines a generally central aperture 104 for receiving the circular cross-section pintle or shaft of the roller shade. The opposing bracket 11' has an opposing supporting configuration 106 including an opposing disk portion 108 defining a keyway 110 for receiving the rectangular cross-section pintle or shaft of the roller shade.

In operation, in connection with the window trim portion 16, the bracket 10 or 11 is initially, substantially flat. The bracket is bent at right angles at the first bend portion 74, the second bend portion 78 and the third bend portion 82 such that the tab portion 71 is received by the slot 70. The tab portion 71 is bent to hold the subsequently formed framing means 63 substantially rigid as previously described. A spot-weld, tack weld or other suitable connection could be used also. It will be understood from the foregoing that bracket 10 or bracket 11 can be formed from each flat member as shown in FIG. 3 depending on which direction the bend portions 74, 78 and 82 are bent. It appears from the drawings, for example FIG. 1, that there is a left hand bracket (e.g., 10) and a right hand bracket (e.g. 11). It will be understood that both the left hand bracket and the right hand bracket can be formed from identical planar members (e.g. FIG. 3). It will be further appreciated that manufacture of the bracket can determine a "left" and "right" hand bracket by the direction in which the blades are bent relative to the bracket. Compound dies cand be used to speed up the manufacturing process. An appropriate compound die can stamp a bracket from a sheet of material, cut the notches for the blades, bend out the blades and bend the substructure in a continuous series of steps with or without turning the bracket over during the process. If this or an equivalent process is used, the "left" and "right" hand brackets can be specifically manufactured.

The blades 68 are pushed out such that the blades depend substantially perpendicular slightly towards the wall from the bracket support portion 66. The blades can be inserted into the top surface 20 of the trim member 16. Experimentation has shown that bending the blades slightly towards the wall tends to force the bracket against the wall for enhanced support of the desired accessory or accessories, e.g., a 5° angle.

Installation is completed by placing either bracket 10 or 11 over the top surface 20, against the wall portion 14 and with the first support portion 76 butted against the side surface 24 or the opposing side surface 30, respectively. The bracket is secured to the trim portion 16 by forcing the blades 68 into the top surface 20. Harder trim material may require the use of a small hammer or rubber mallet to insure that the blades 68 penetrate the upper frame member or trim portion 16. No other tools should be required for typical bracket installation. No fasteners are required; no screws, nails or tacks. It will be understood that the invention does not depend upon the framing material used to construct the trim. If a material is used, such as stone, or a dense wood, then suitable adhesive means could be substituted for the blade member or members. Thus, the bracket of the present invention can also be used with stone or plaster, for example, a stone mantle or other material that a blade could not penetrate or an antique material in which penetration marks are not desired. The adhesive used will depend on the material and will be selected after suitable consideration. The wide range of available adhesives will be known to one skilled in this area. The adhesive could be applied to the bracket in lieu of blades at the locations shown in the drawings for the blades. Double sided adhesive members 112 and 114 could be used, for example, with an outward directed face protected with a contact sheet until use. Furthermore, it will be understood that an adhesive material as previously described could replace the blades in many if not all installations since there is little horizontal force acting on the blades or adhesive.

No measurements are needed. The brackets preferably have identical dimensions including the longitudinal spacing between bend portion 74, 78 and 82 in the preferred embodiment. Providing that trim 16 and wall 14 are true and plumb then the trim 16 and the wall 14 can be used for alignment and provide a true and plumb alignment of the brackets 10 and 11, and true and plumb alignment of the supported accessory or fixture such as the curtain rod 34 or a window shade. In the event that the window frame, door frame or the like has not been installed plumb or has shifted over time with the building or wall, then use of brackets of the present invention will support accessories that match the slope of the shifted structure. Thus, the supported accessories or members parallel the frame or trim member and do not call attention to the shift. This feature can be quite desirable in older homes.

Another feature of the bracket of the present invention is illustrated generally in FIG. 4. A plurality of brackets have been outlined on a sheet of material as an outline for die-stamping, electric discharge machining or other separation method.

A portion or piece of metal sheet stock 120 is shown with brackets 122, 123, 124 and part of brackets 126, 127, 128, 129, 130 and 131. The bracket is configured to minimize waste. The bracket configuration minimizes waste by means of selecting dimensions "A" and "B", for example, such that the accessory support means 56 or 58 has a length slightly less than the length of the joining member 60. The dimensions "C" and "D" can be selected to allow the support means 56 or 58 to fit into a notch 132. It will be understood that the pattern illustrated in FIG. 4 can be duplicated either longitudinally as shown and/or laterally as shown by partial illustration of brackets. Similarly, other dimensions can be selected to allow the support portion extension 86 to fit intermediate adjacent supporting configurations, as illustrated in FIG. 4. The nominal dimensions indicated in FIG. 7 further some dimensions providing for illustrate the manner in which a plurality of brackets can be cut or separated from sheet stock and minimize waste.

Figure 7:
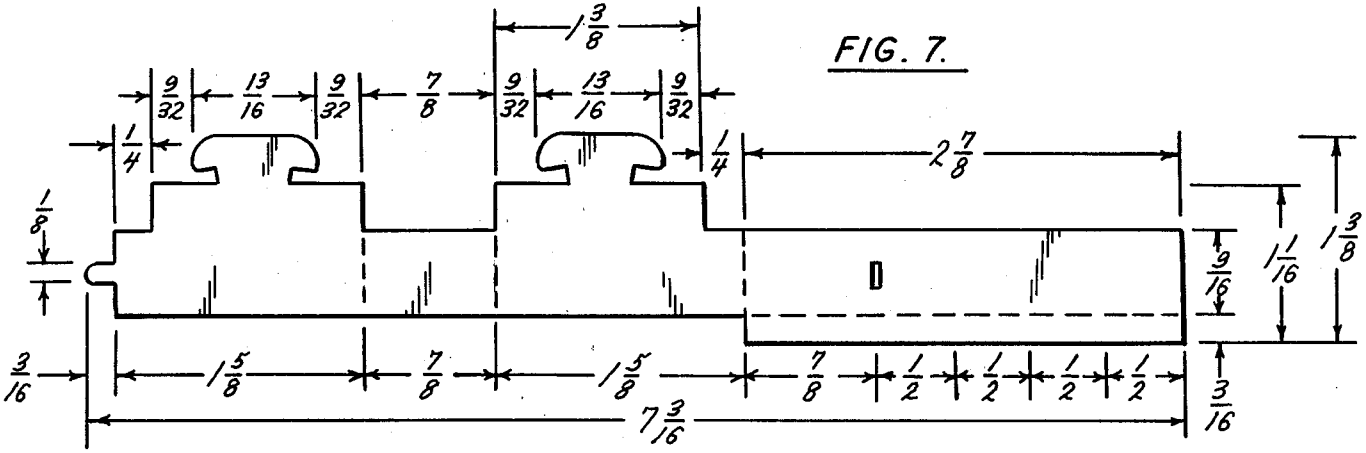
FIG. 7 is a plan view of a bracket in accordance with this invention.

While specific embodiments have been shown and described, many variations are possible. The particular shape of the bracket including its dimensions may be changed as desired to suit the use or fixture with which it is intended to be used. FIG. 7 illustrates the dimensions of a preferred embodiment. The configuration may change for example from supporting two fixtures or rods one fixture or rod or more than two fixtures or rods. The configuration in FIG. 1, for example, illustrates a double supporting bracket at either end of the molding of a window frame. In a typical application of the present invention the inner supports hold a rod for a drape and the outer supports hold a rod for a panel. The panel conceals the brackets and drapery rods. In a simplified version of the invention the flange can be deleted or the slot and tab configuration can be modified. The bracket can be provided with either one or two supporting configurations. The supporting configurations on each bracket, if more than one is required, can be the same or different if different fixtures are to be supported by a single bracket. Another feature of the invention is to provide a bracket that can be used with trim, framing, molding or the like that has become split, cracked or otherwise deteriorated due to conditions, misuse or too many brackets previously nailed, screwed or otherwise fastened thereto.

Having described the invention in detail, those skilled in the art will appreciate that modifications may be made of the invention without departing from the spirit. Therefore, it is not intended that the scope of the invention be limited to the specific embodiments illustrated and described. Rather, it is intended that the scope of this invention be determined by the appended claims and their equivalents.

What is claimed is:

1. A bracket comprising:

(a) bracket support means for supporting the bracket on a portion of a trim member, the bracket support means including an attachment member attachable to the trim member portion for supportably attaching the bracket on the trim member portion, (b) accessory support means for supporting an accessory, the accessory support means including a supporting configuration for supportably receiving the accessory, (c) framing means defined by the accessory support means for providing a substantially rigid sub-structure is at least partially supportable by a wall portion adjacent the trim member as a result of the weight of the accessory supported by the bracket, which accessary weight further results in improved support of the bracket and the accessory, (d) the accessory support means including a first support portion and a second support portion, (e) connecting means for connecting the second support portion and the bracket support means and further defining framing means, (f) the bracket support means includes a substantially planar bracket support portion, (g) the connecting means includes a bendable tab portion extending generally longitudinally from the second support portion, and (h) the connecting means further including a slot for receiving the bendable tab portion, the slot defined by the substantially planar bracket support portion.

2. A bracket as set forth in claim 1, wherein:

(i) the spacing of the substantially planar bracket support portion, the first support portion, the intermediate connecting portion, the second support portion and the bendable tab portion are spaced relative to each other, so as to substantially minimize material waste when a plurality of brackets are stamped or otherwise separated from a sheet of the material.

* * * * *